US005690756A

United States Patent [19]

Fujiwara et al.

[11] Patent Number: 5,690,756

[45] Date of Patent: Nov. 25, 1997

[54] METHOD FOR PRODUCING CAST IRON GEAR

[75] Inventors: Yasuyuki Fujiwara, Nishikamo-gun; Izuru Yamamoto, Toyota; Masazumi Onishi, Toyota; Toshiaki Tanaka, Nagoya; Yoshinari Tsuchiya, Kasugai; Atsushi Danno, Nagoya, all of Japan

[73] Assignee: Toyota Jidosha Kabushiki Kaisha, Aichi-ken, Japan

[21] Appl. No.: 617,282

[22] Filed: Mar. 18, 1996

[30] Foreign Application Priority Data

Mar. 29, 1995 [JP] Japan ..... 7-071751

[51] Int. Cl.[6] ..... C21D 8/00; C21D 9/32; C23C 8/26

[52] U.S. Cl. ..... 148/586; 148/615; 148/211; 148/212; 148/230

[58] Field of Search ..... 148/211, 212, 148/230, 586, 615

[56] References Cited

U.S. PATENT DOCUMENTS

| | | | |
|---|---|---|---|
| 5,082,507 | 1/1992 | Curry . | |
| 5,221,513 | 6/1993 | Amateau et al. . | |
| 5,516,376 | 5/1996 | Tsukamoto et al. | 148/586 |

FOREIGN PATENT DOCUMENTS

| | | | |
|---|---|---|---|
| A-60-162726 | 8/1985 | Japan . | |
| 62-127425 | 6/1987 | Japan | 148/586 |
| A-62-282766 | 12/1987 | Japan . | |
| 64-26046 | 1/1989 | Japan . | |
| 403122214 | 5/1991 | Japan | 148/586 |
| 5-93225 | 4/1993 | Japan . | |
| A-5-93225 | 4/1993 | Japan . | |

OTHER PUBLICATIONS

Patent Abstracts of Japan, vol. 17 No. 426 (C-1094), Aug. 9, 1993.

Patent Abstracts of Japan, vol. 12, No. 164 (M-698), May 18, 1988.

Patent Abstracts of Japan, vol. 9, No. 331 (C-321), Dec. 25, 1985.

*Primary Examiner*—Deborah Yee
*Attorney, Agent, or Firm*—Oliff & Berridge

[57] ABSTRACT

A method for producing cast iron gears includes the steps of heating a blank composed of cast iron and having a teeth forming part to such a temperature that at least the teeth forming part is at least austenitized, and hot rolling the teeth forming part of the blank by pressing projecting teeth of a rolling machine against the teeth forming part which is in a hot state and within an austenitized range, while cooling the blank, thereby generating a teeth part in the teeth forming part of the blank. Hot rolling with a low plastic deformation resistance prevents lowering of strength due to the exposure of graphite particles of cast iron and occurrence of quenching cracks and rolling cracks, and improves gear accuracy.

13 Claims, 12 Drawing Sheets

×50
NO ETCHING

×50
NO ETCHING

×400
NITAL ETCHING

×400
NITAL ETCHING

×400
NITAL ETCHING

| | HEATING TEMPERATURE (°C) | WORKING RATIO (%) |
|---|---|---|
| ○ | 1140 | 0 |
| ● | 1100 | 0 |
| △ | 1140 | 60 |
| ▲ | 1100 | 60 |

METHOD FOR PRODUCING CAST IRON GEAR

BACKGROUND OF THE INVENTION

1. Field of the Invention

The present invention relates to a method for producing a cast iron gear, and more particularly, to a method for producing a cast iron gear by hot rolling.

2. Description of the Related Art

Conventionally, following two methods have been well known as examples of the method for producing cast iron gears:

(1) A circular plate of nodular graphite cast iron is subjected to gear cutting to generate teeth along a periphery thereof, and the generated teeth are subjected to induction hardening and tempering to impart good wear resistance and toughness thereto;

(2) Molten nodular graphite cast iron is poured into a cavity of a casting mold manufactured by a precision casting process such as a reduced pressure-molding process, and is solidified therein, thereby casting teeth along with a base part, then, a rolling die is pressed against the teeth to finish them by cold rolling with high accuracy, and tooth surfaces are hardened by induction hardening (Japanese Patent application laid-open No. Sho 64-26046).

The cast iron gears produced by the above two methods have problems as follows:

(1) Where the teeth are generated by gear cutting, productivity and production costs are both insufficient, and graphite particles are exposed from the generated teeth to define notches, which cause stress concentration and decrease the strength thereof. Upon induction hardening, quenching cracks may occur, because cast iron contains a greater amount of carbon and silicon as compared to steel.

(2) Where the teeth are generated by using the precision casting process such as the reduced pressure-molding process, casting costs are expensive. Upon cold rolling for finishing the teeth, rolling cracks may occur, because the deformation ability of cast iron (including ductile cast iron) in cold range is small, and graphite particles of cast iron are crushed and exposed from the tooth surfaces to lower the strength thereof. Furthermore, in the subsequent induction hardening process, residual stress due to cold rolling is released to reduce the gear accuracy.

Japanese patent application laid-open No. Hei 5-93225 discloses a method for producing east iron gears, which includes heating a blank composed of nodular graphite cast iron and having teeth along a periphery of a base part thereof to an austenitizing temperature range, cooling the blank thus heated to a bainite temperature range, and subjecting the blank thus cooled to a rolling process in this temperature range, then, finishing the teeth by warm rolling. This method can overcome the above-described problems (1) and (2), but is disadvantage in productivity and production costs, because it uses isothermal transformation and warm finishing rolling, and accordingly, the treating time thereof is long.

SUMMARY OF THE INVENTION

It is an object of the present invention to provide a method for producing cast iron gears having high accuracy and free from lowering of strength caused by the exposure of graphite particles, and occurrence of quenching cracks and rolling cracks, accordingly, having great strength, with good productivity and at reduced production costs.

The method of the present invention includes the steps of heating a blank composed of cast iron and having a teeth forming part such that the temperature of at least the teeth forming part of the blank rises to at least an austenitizing temperature range (heating process), and subsequently pressing projecting teeth of a rolling machine against the teeth forming part of the blank, which is in a hot state within the austenitizing temparature range, while cooling the blank heated, thereby generating a teeth part in the teeth forming part of the blank (hot rolling process).

The hot rolling process may be carried out when the teeth forming part is in an austenite-ferrite phase range, a stable austenite range, or a supercooling or metastable austenite range. Alternatively, the hot rolling process may be ended during the transformation of the teeth forming part to pearlite. Where the working ratio is small, like in a sizing process, hot rolling is preferably carried out during the transformation of the teeth forming part to pearlite.

In a preferred embodiment, in the heating process, the blank is held in the temperature range lower than its melting start temperature by 10° to 160° C.

In another preferred embodiment, the heating process is carried out such that the teeth forming part is austenitized to the depth of 1.5 to 1.8 times the total depth of the teeth part to be generated, and this heating condition is maintained throughout the hot rolling process. Furthermore, in the hot rolling process, the temperature of the teeth forming part adapted to form not less than 90% of the total depth of the teeth part to be generated is maintained at notless than 750° C.

In still another preferred embodiment, after the heating process, the blank is cooled from 1000° to 600° C. at a rate of not less than 25° C./s. and then cooled from 600° to 400° C. at a rate of not less than 10° C./s., whereby the resultant teeth part has a pearlite-based structure or mixed structure of martensite and fine pearlite.

In a further preferred embodiment, after the heating process, the blank is cooled from 1000° to 600° C. at a rate of not less than 25° C./s., and then cooled from 600° to 400° C. at a rate of not less than 1° C./s. and less than 10° C./s., or the blank is cooled from 1000° C. to 600° C. at a rate of not less than 1° C./s. and less than 25° C./s., whereby the resultant teeth part has a fine pearlite-based structure or mixed structure of ferrite and pearlite.

In a still further preferred embodiment, after the hot rolling process, at least one of a nitriding treatment, a softnitriding treatment and a sulphurizing and nitriding treatment is carried out.

With the method of the present invention, the blank is heated such that the temperature of at least the teeth forming part rises to at least the austenitizing temperature range, and during cooling of the blank thus heated, the projecting teeth of the rolling machine are pressed against the teeth forming part thereof in the austenitizing temperature range to generate the teeth part in the teeth forming part of the blank.

Since the teeth part is generated by hot rolling, the rolling process can be carried out in the state exhibiting large deformability so that the occurrence of rolling cracks can be prevented, and the exposure of graphite particles from the tooth surfaces can be extremely reduced, thus preventing lowering of strength due to the formation of notches which would be formed due to the exposure of graphite particles.

Since the teeth part is generated using the plastic deformation of the blank at temperatures near the transformation temperature, old γ particles in tooth surfaces are made fine. In particular, old γ particles in bottom lands which have high working ratios and are required to have high strength are made finer. When the surface where old γ particles are made fine is subjected to hardening, it is austenitized at a relatively low temperature, to effect a metallic structure of fine martensite, thus enabling the production of parts having high strengths. As described above, by generating the teeth part with hot rolling, the structure is made fine to reduce the quenching crack susceptibility of the cast iron material containing a great amount of carbon and silicon which would cause the occurrence of quenching cracks, thus preventing the occurrence of the quenching cracks.

Furthermore, since the teeth part is generated by hot rolling, working stress hardly remains. Accordingly, upon reheating in the hardening, tempering, nitriding or the like process, lowering of accuracy due to the release of residual stress hardly takes place.

In addition, the method in accordance with the present invention is superior to the conventional gear cutting method in productivity and production costs.

In the heating process of the present invention, by holding the blank in a high temperature range, which is lower than its melting start temperature only by 10° to 160° C., carbon can disperse throughout a matrix of the teeth forming part in a short time, because the dispersing rate of carbon increases with temperature. This enables the improvement in productivity and prevents lowering of accuracy due to the thermal transmission throughout the blank, which would be caused by a long heating time. Furthermore, by increasing the carbon content of the matrix composing the teeth forming part to a predetermined value, the hardness thereof after cooling can be improved.

In the heating process of the present invention, by heating the teeth forming part of the blank so as to be austenitized to the depth of 1.5 to 1.8 times the total depth of the teeth part to be generated, and carrying out the hot rolling process in this heating state and such that the teeth forming part adapted to generate not less than 90% of the total depth of the teeth part is maintained at not less than 750° C., the occurrence of flaws in the tooth surfaces can be effectively reduced. If the heating depth H to be austenitized is made less than 1.5 times the total tooth depth h, the material run in tooth bottoms becomes worse so that folding defects may take place not to effectively reduce the occurrence of flaws in the tooth surfaces. If the heating depth H is increased greater than 1.8 times the total tooth depth h, the required heating time becomes longer, which lowers productivity and may lower the gear accuracy. If the temperature for forming 90% of the total tooth depth in the teeth forming part is decreased below 750° C., the deformation resistance of material becomes greater, and the material run becomes worse, thus not effectively reducing the occurrence of flaws in the tooth surfaces.

In accordance with the present invention, the cooling rate of the heated blank is not specifically limited. By setting the cooling rate so as to realize the following structures, characteristic operational effects and advantages can be achieved.

Where the cooling rate of not less than 25° C./s. is set in the temperature range from 1000° to 600° C. to restrain the ferrite and pearlite transformation, and the cooling rate of not less than 10° C./s. is set in the temperature range from 600° to 400° C. to restrain the formation of pearlite and bainite phases, a martensite-based structure or structure composed of martensite partially mixed with fine pearlite, which is a metallic structure having great strength, can be obtained without a hardening process such as an induction hardening process.

Accordingly, quenching cracks which have been frequently encountered with conventional cast iron can be prevented, and productivity and production costs are both superior to those of the conventional cast iron.

By subjecting the blank thus cooled to tempering at a proper temperature, the hardness thereof can be properly adjusted. Furthermore, by adjusting the composition of the cast iron and cooling conditions strictly, the martensite-based structure or the mixed structure of martensite and fine pearlite is obtained. The latter structure is superior to the former structure in toughness of the resultant teeth part.

Where the cooling rate of not less than 25° C./s. is set in the temperature range from 1000° to 600° C., and the cooling rate of not less than 1° C./s. and less than 10° C./s. is set in the temperature range from 600° to 400° C., or the cooling rate of not less than 1° C./s. and less than 25° C./s. is set in the temperature range from 1000° to 600° C., the resultant structure of the teeth part is composed of a fine pearlite-based structure or mixed structure of ferrite and pearlite, which exhibits high toughness, as compared to that of the martensite-based structure. In this case, it is preferable to carry out the hardening process of reheating with high density energy and permitting to cool after the hot rolling process, thus improving the strength of resultant blank. By reheating, the structure is austenitized in a short time at relatively low temperatures, and by cooling, the martempering effect of forming a homogeneous martensite structure is achieved to decrease the distortion property and prevent the occurrence of quenching cracks further. In addition, the hardness and wear resistance can be also improved. By tempering the blank thus cooled at a proper temperature, the hardness thereof can be properly adjusted. By the strict adjustment of the composition of the cast iron and cooling conditions, a fine pearlite-based structure or a mixed structure of ferrite and pearlite is obtained. The fine pearlite-based structure is superior to the mixed structure composed of ferrite and pearlite in tensile strength, wear resistance and hardness.

If, after hot rolling, at least one of nitriding, softnitriding and sulphurizing and nitriding treatment is carried out at temperatures lower than the austenire formation temperature, a hard film can be formed on the tooth surfaces to improve wear resistance and impact strength thereof. Normally, cast iron is difficult to be nitrided, because of the existence of silicon, but, by virtue of an oxide film formed on the surface of the teeth part by hot rolling, the nitrization of cast iron can be promoted, thus enabling the above various nitriding treatments effectively. These treatments serve as the tempering treatment so that a separate tempering treatment is unnecessary.

Other objects, features, and characteristics of the present invention will become apparent upon consideration of the following description and the appended claims with reference to the accompanying drawings, all of which form a part of this specification.

DETAILED DESCRIPTION OF THE PRESENTLY PREFERRED EXEMPLARY EMBODIMENTS

Hereinafter, the present invention will be explained based on several embodiments where cylindrical helical gears are produced.

FIGS. 1 to 9 illustrate a first embodiment of a method in accordance with the present invention.

Figure 1:
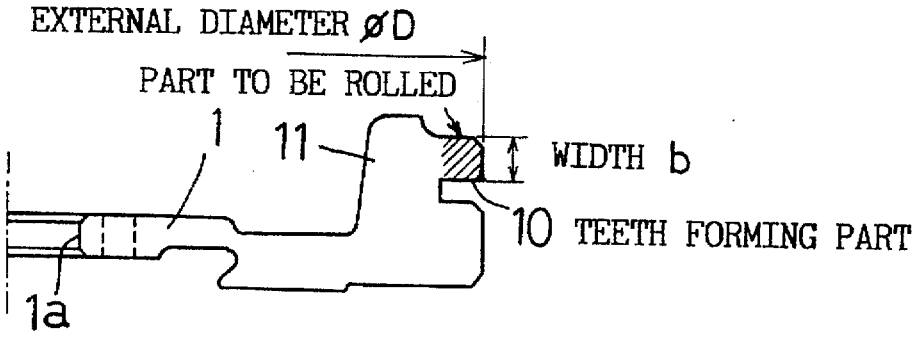
FIG. 1 is a side elevational view of one part of a gear blank used in a first embodiment of a method in accordance with the present invention.

As shown in FIG. 1, a blank 1 was prepared by machining nodular graphite cast iron (FCD 450). The blank 1 has a generally cylindrical configuration and has a central hole 1*a*. The blank 1 has a ring-like projection 11 which projects upwardly from an outer peripheral part thereof, and a teeth forming part 10 which protrudes radially outwardly from the projection 11 and has an external diameter(ϕD) of 270.35 mm and a width(b) of 11 mm. This teeth forming part 10 hatched in FIG. 1 is adapted to be rolled.

Figure 2:
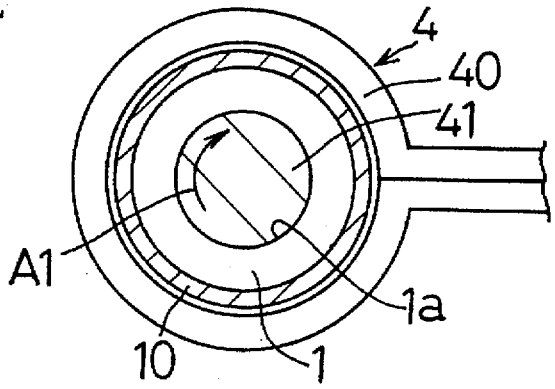
FIG. 2 is a view illustrating a teeth forming part of a gear blank, which is being subjected to induction heating in a heating process.

Next, the blank 1 which was at normal temperature was placed in an induction heating coil device 4 shown in FIG. 2. A work arbor 41 was set in the central hole 1*a* of the blank 1 and a heating coil 40 was set coaxially with the blank 1 such that the inner periphery of the heating coil 40 faced the outer periphery of the teeth forming part 10. Then, a high frequency current was directed to the heating coil 40 while rotating the blank 1 with the work arbor 41 in the direction of the arrow A1 to carry out high frequency induction heating of the teeth forming part 10. This results in the teeth forming part 10 (the area hatched in FIG. 2) being heated to the depth H of about 8.3 mm, which is 1.5 times the total tooth depth h of a gear to be produced, at about 1100° C. to be austenitized. The induction heating conditions can be arbitrarily selected. In this embodiment, power of 60 kW, frequency of 10 kHz, and heating time of 80 seconds were selected. The inside temperature of the projection 11 of the blank 1 was about 200° to 400° C.

Figure 3:
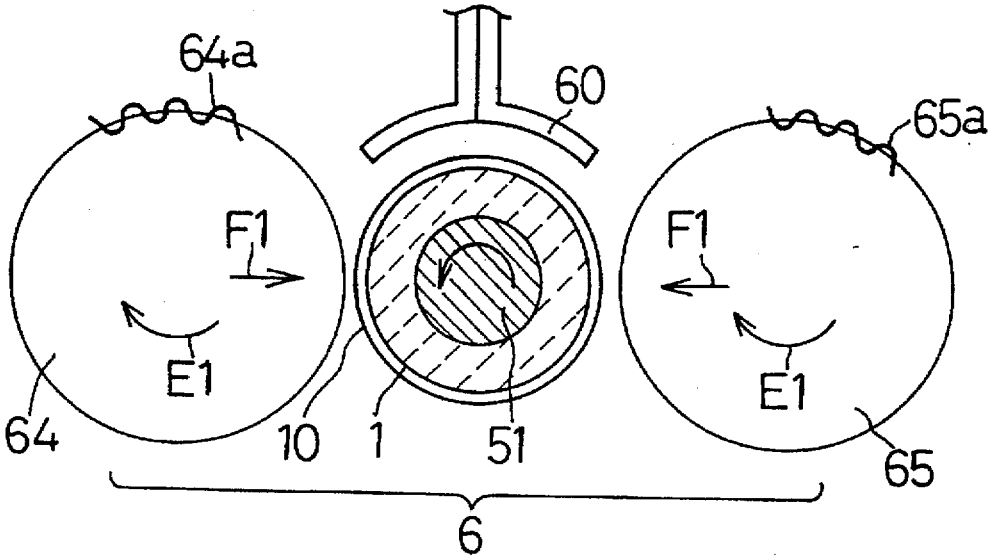
FIG. 3 is a schematic diagram of a rolling machine having a pair of dies.

Then, as shown in FIG. 3, a work arbor 51 of a chuck device (not shown) was set in the central hole 1*a* of the blank 1, and the blank 1 was transferred to a hydraulically pushing type rolling machine 6 including a sector-like auxiliary heating coil 60. The teeth forming part 10 was faced with the auxiliary heating coil 60 and was subjected to high frequency induction heating with the auxiliary heating coil 60 immediately before the rolling process. This compensates temperature lowering of the blank 1 due to its transfer from the induction heating coil device 4 to the rolling machine 6 to return the blank 1 to its heated condition after high frequency induction heating. The rolling machine 6 further includes a pair of pinion type roller dies 64 and 65, each being composed of steel and having a large number of teeth 64*a* or 65*a* along an outer periphery thereof. The roller dies 64 and 65 are driven by a driving mechanism. During cooling the blank 1, the roller dies 64 and 65 were rotated in the direction of the arrow E1 and moved in the directions of the arrow F1 by hydraulic cylinders so as to bring them close to each other. This results in the teeth 64*a* and 65*a* of the roller dies 64 and 65 being pressed against the teeth forming part 10 of the blank 1 to carry out hot rolling. During hot rolling, the blank 1 is also rotated.

Hot rolling was started at 1000° C. and finished at approximately 600° C. The rolling time was about 7 seconds. The maximum heating temperature of 1100° C. was held for 10 seconds. The working load in hot rolling was 40 kN. The average cooling rate in the temperature range from 1000° to 600° C. was 50° C./s. and that in the temperature range from 600° to 400° C. was 2° C./s.

After hot rolling, the gear blank 1 was subjected to high frequency hardening with a high frequency hardening coil under 40 kHz and 200 kW. The teeth part were heated to 950° to 1100° C. (1050° C. in the present embodiment) in 8 seconds and immediately allowed to cool. Merely with self cooling, sufficiently good hardness can be obtained. Alternatively, refrigerant may be sprayed for cooling the teeth part. The preferred cooling time for lowering the heating temperature to 500° C. is 20 seconds or less and that from MS point to room temperature is 30 seconds or more, which prevents the occurrence of quench cracks with greater certainty.

After high frequency hardening, the blank 1 was held at approximately 160° to 560° C. for 3600 seconds to carry out tempering. Thus, a cast iron gear of the first embodiment was produced. The resultant gear dimensions are 2.5 in module, 0° in spiral angle, 106 in number of teeth and 13 mm in face width.

(Evaluation)

Static bending test, Izod impact test and bending fatigue test of the cast iron gears of the first embodiment were performed. The static bending test was performed by pressing downwardly with a pressing member or Amsler universal testing machine until one of teeth of the cast iron gears was broken. The Izod impact test was performed by sharpening only one tooth of the cast iron gears, supporting it at its base end and striking its tip end. The fatigue test was performed by securing a test tooth of the cast iron gears in engagement with a facing gear, and applying pulsation torque thereto.

Figure 4:
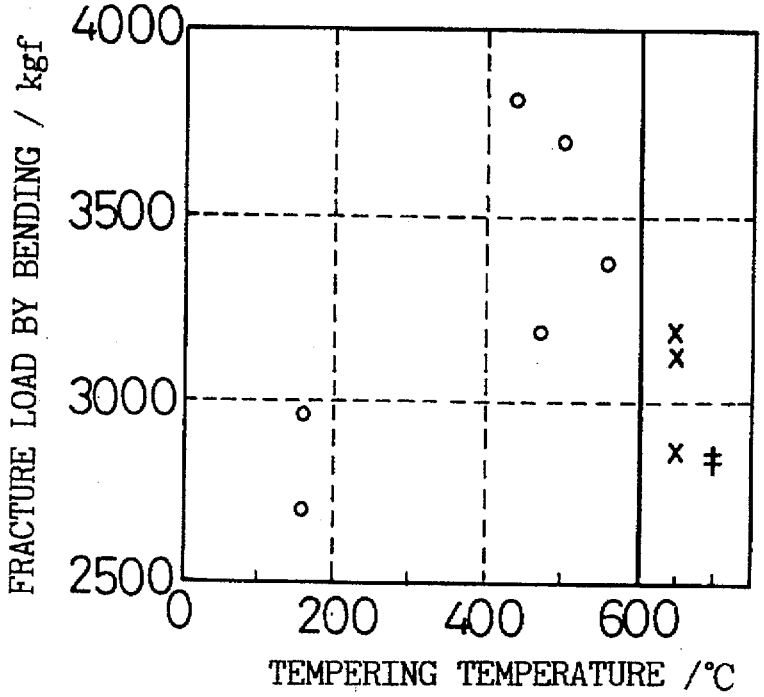
FIG. 4 is a graph showing the result of the static bending test of a cast iron gear produced by a first embodiment of a method in accordance with the present invention.
Figure 5:
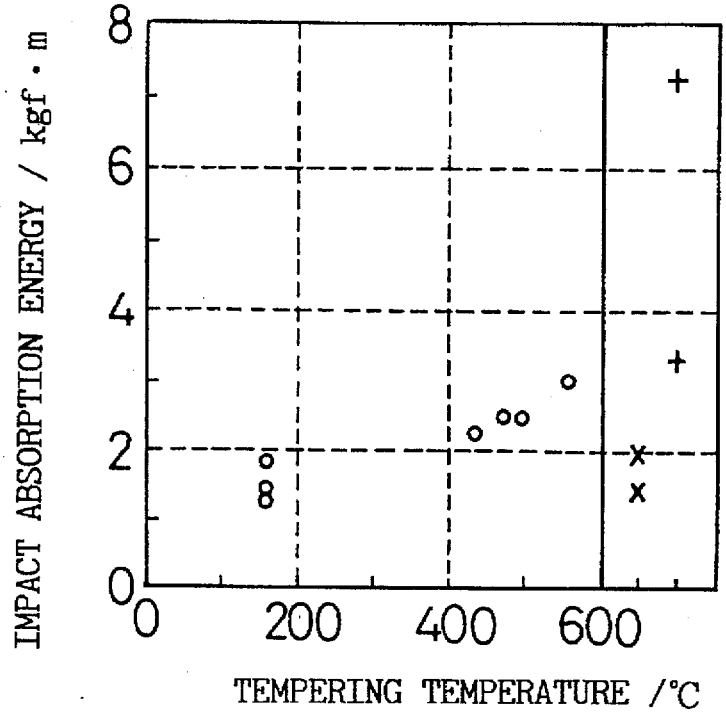
FIG. 5 is a graph showing the result of the Izod impact test of the cast iron gear produced by the first embodiment.
Figure 6:
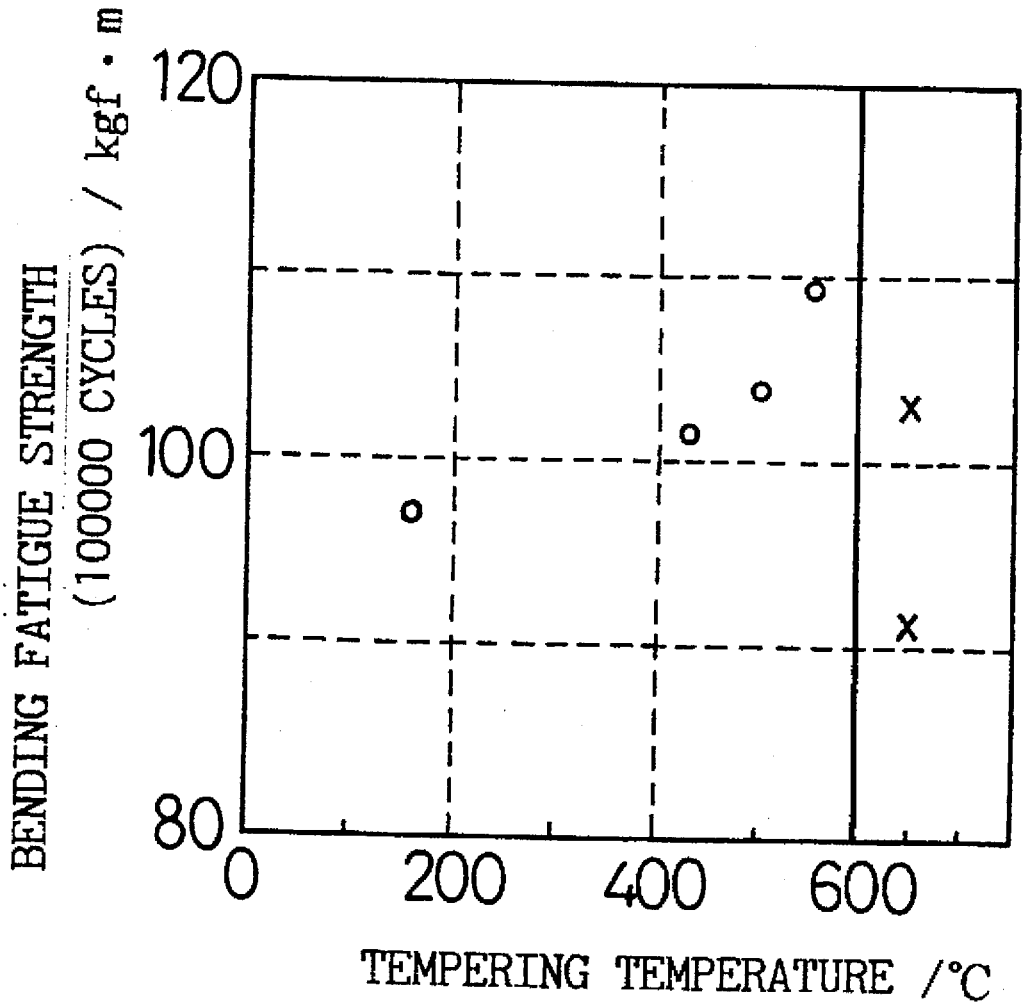
FIG. 6 is a graph showing the result of the bending fatigue test of the cast iron gear produced by the first embodiment.

The results of the static bending test, Izod impact test and fatigue test are respectively shown in FIGS. 4, 5 and 6. In FIGS. 4 to 6, symbol ○ shows the results of the east iron gears of the first embodiment, and symbol x shows the comparative results of conventional gears, each having identical dimensions ( except for the face width of 9 mm), which are respectively composed of steel and were subjected to high frequency hardening and tempering.

As is apparent from FIGS. 4 to 6, the east iron gears of the first embodiment exhibit satisfactory evaluation results as cylindrical gears in all of the static bending test, Izod impact test and fatigue test.

Figure 7:
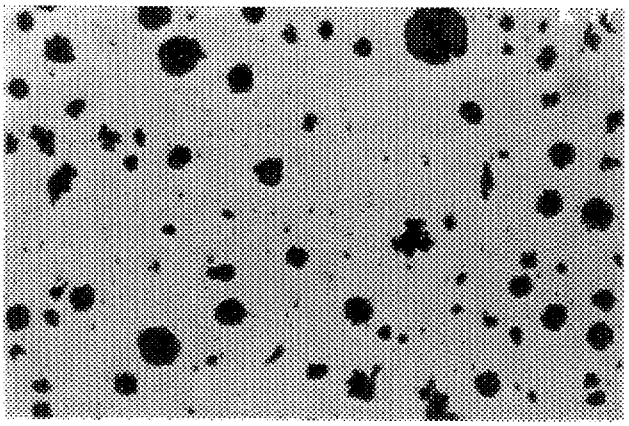
FIG. 7 is a photograph (50×, no etching) of a metallic structure of a teeth forming part of the gear blank produced by the first embodiment
Figure 8:
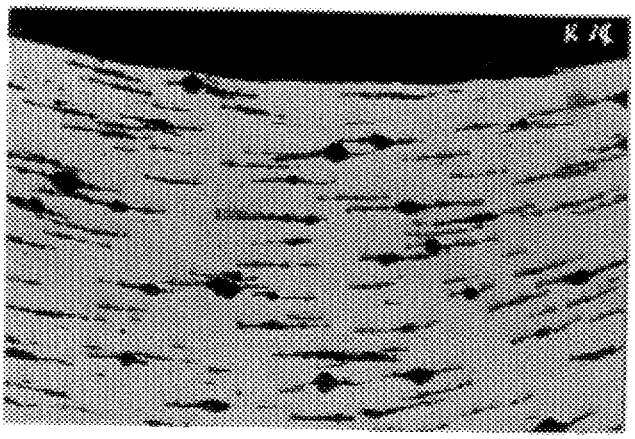
FIG. 8 is a photograph (50×, no etching) of a metallic structure of a tooth bottom, which is obtained after a hot rolling process of the first embodiment.
Figure 9:
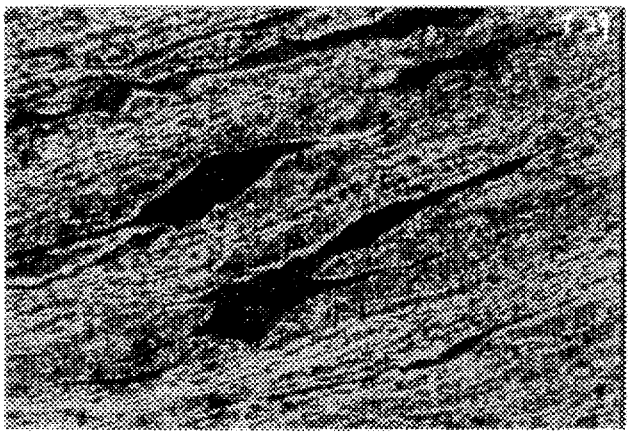
FIG. 9 is a photograph (400×, nital etching) of a metallic structure of the tooth bottom, which is obtained after the hot rolling process of the first embodiment.

FIG. 7 is a photograph (50×, no etching) showing the metallic structure of the teeth forming part 10 of the gear blank 1 of the first embodiment, FIG. 8 is a photograph (50×, no etching) showing the metallic structure of the tooth bottom after hot rolling, and FIG. 9 is a photograph (400×, nital etching) showing the metallic structure around the tooth bottom after hot rolling.

As is apparent from FIGS. 7 to 9, due to hot rolling, the nodular graphite particles were crushed into flat particles in the surface of the tooth bottom. By setting a cooling rate of not less than 25° C./s. (50° C./s. in the first embodiment) in the temperature range from 1000° to 600° C. and setting a cooling rate of less than 10° C./s. and not less than 1° C./s. (average 2° C./s. in the first embodiment) in the temperature range from 600° to 400° C., the metallic structure around the tooth bottom after hot rolling was transformed to a fine pearlite-based structure. By setting a cooling rate of not less than 1° C. and less than 25° C./s. in the temperature range from 1000° to 600° C. and setting a cooling rate of less than 10° C./s. in the temperature range from 600° to 400° C., the metallic structure after hot rolling was transformed to a mixed structure of ferrite and pearlite.

In the teeth part after hot rolling, no rolling crack was observed, and in the teeth part after high frequency hardening, no quenching crack was observed.

Upon evaluation, the gear accuracy of the cast iron gear of the first embodiment was in the sixth class of JIS.

Hereinafter, a second embodiment will be explained. A blank substantially identical to the blank 1 of the first embodiment was prepared and was subjected to heating, similarly to the first embodiment, and hot rolling by using a rolling machine having dimensions substantially identical to those of the first embodiment.

In the second embodiment, the cooling rate in the temperature range from 1000° to 600° C. was 50° C./s., similarly to the first embodiment, but, as is different from the first embodiment, a cooling rate of 25° C./s. was set in the temperature range from 600° to 400° C. by spraying water, because the cooling rate with self cooling is less than 10° C./s. Thus, the metallic structure was transformed to a martensite-based hardened structure sufficiently even after rolling and cooling.

Next, tempering was carried out, similarly to the first embodiment, thus producing a cast iron gear of the second embodiment.

The result of the strength evaluation of the cast iron gear of the second embodiment was similar to that of the first embodiment.

Figure 10:
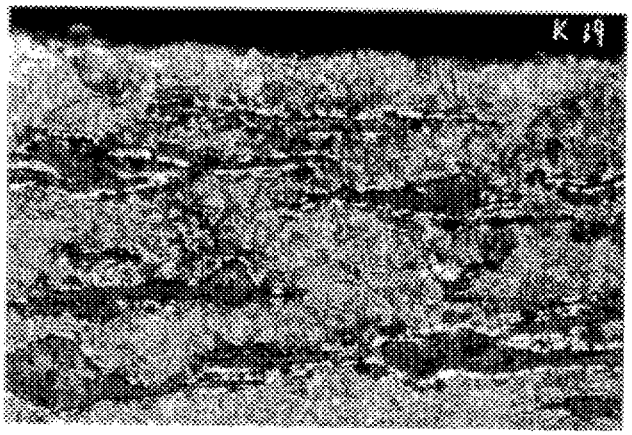
FIG. 10 is a photograph (400×, nital etching) of a metallic structure of a tooth bottom, which is obtained after a hot rolling process of a second embodiment of a method in accordance with the present invention.

FIG. 10 is a photograph (400×, nital etching) showing the metallic structure of the tooth bottom after hot rolling. As shown, the metallic structure of the tooth bottom after hot rolling was transformed to a martensite-based structure by cooling from 1000° to 600° C. at a rate of not less than 25° C./s. (50° C./s. in the second embodiment), and subsequently cooling from 600° to 400° C. at a rate of not less than 10° C./s. (25° C./s. in the second embodiment).

Hereinafter, a third embodiment of the present invention will be explained. A blank similar to the blank 1 of the first embodiment was heated with high frequency induction heating for 100 seconds under 50 kW and 10 kHz such that the teeth forming part 10 of the gear blank was heated up to about 1100° C. to the depth H of about 9.5 mm, which corresponds to 1.7 times the total tooth depth h of a gear to be produed, and subsequently subjected to hot rolling.

The initial hot rolling temperature was 1000° C., the final hot rolling temperature was about 700° C., the rolling time was about 8 seconds and the working load was 30 kN. The duration of the maximum heating temperature (1100° C.) was 20 seconds. A cooling rate of 40° C./s. was set in the temperature range from 1000° to 700° C. with both self cooling and cooling by the roller dies 64 and 65. Next, water was sprayed onto the blank such that a cooling rate of 30° C./s. was set in the temperature range from 700° to 600° C. and a cooling rate of 8° C./s. was set in the temperature rage from 600° to 400° C. Then, water was stopped and an average cooling rate of 1.5° C./s. was set in the temperature range from 400° C. to room temperature. Thus, a gear with a metallic structure having an average hardness of 400 Hv (20 kgf), which was a mixed structure of martensite and fine pearlite, was obtained.

This gear exhibits high strength without being subjected to tempering, which is on substantially the same level with that of the first embodiment including the tempering process at 500° C.

Figure 11:
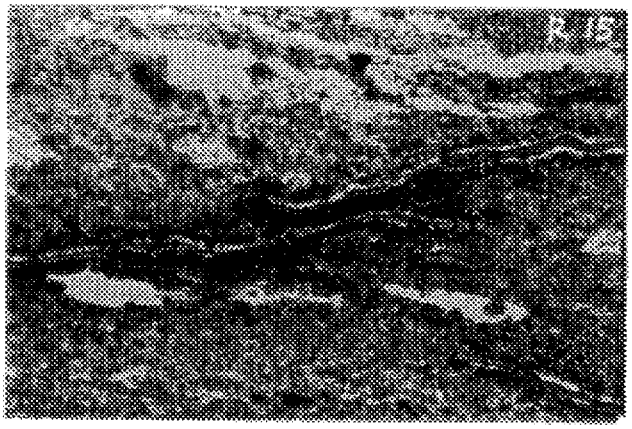
FIG. 11 is a photograph (400×, nital etching) of a metallic structure of a tooth bottom, which is obtained after a hot rolling process of a third embodiment of a method in accordance with the present invention.

FIG. 11 is a photograph (400×, nital etching) showing the metallic structure of the tooth bottom after hot rolling. As shown, the metallic structure of the tooth bottom after hot rolling was transformed to a mixed structure of martensite and fine pearlite by cooling from 1000° to 600° C. at a rate of not less than 25° C./s. (40° C./s. and 30° C./s. in the third embodiment), and subsequently cooling from 600° to 400° C. at a rate of not less than 1° C./s. and less than 10° C./s.(8° C./s. in the third embodiment).

Hereinafter, a fourth embodiment will be explained. A blank similar to the blank 1 of the first embodiment was prepared by machining nodular graphite cast iron (FCD500). The initial melting temperature of this blank was 1160 °C.

Figure 12:
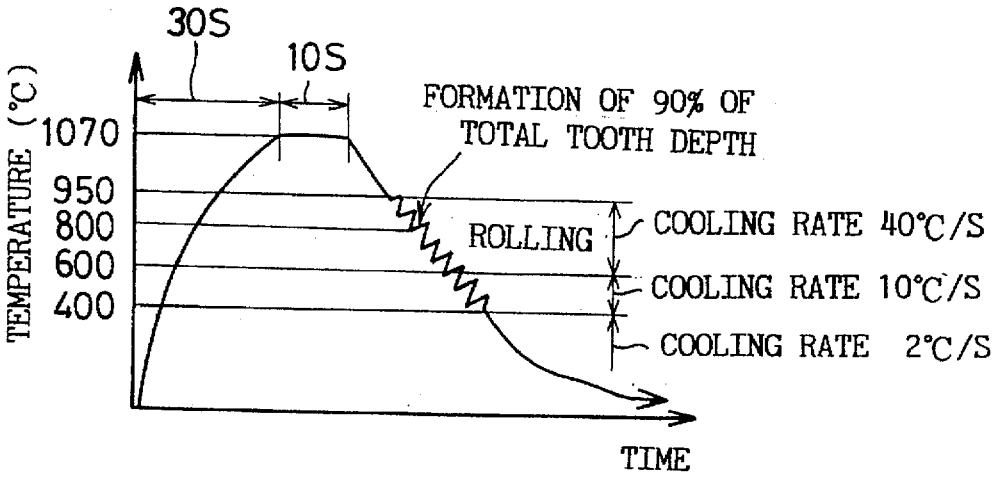
FIG. 12 is a graph showing the temperature history in a fourth embodiment of a method in accordance with the present invention.

Next, the blank was heated by an induction heating coil device, similarly to the first embodiment, such that, as shown in FIG. 12, the teeth forming part of the blank was heated up to 1000° to 1150° C. (1070° C. in the pesent embodiment) to the depth H of about 11 mm, which was 1.6 times the total tooth depth h of a gear to be produced, in 30 to 35 seconds (30 seconds in the present embodiment). This temperature was held for 10 seconds. The induction heating conditions can be arbitrarily selected. In this embodiment, power of 70 kW and frequency of 10 kHz were selected. The carbon content of the matrix composing the teeth forming part was 0.8%.

Then, while cooling the blank, the teeth forming part was subjected to hot rolling by a rolling machine, similarly to the first embodiment, to produce a cast iron gear. The initial rolling temperature was from 900° to 1100° C. (950° C. in the present embodiment), the final temperature of roller pushing for forming 90% of the total tooth depth was 800° C., the final temperature of hot rolling, which corresponds to that of sizing, was from 380° to 380° C. (400° C. in the present embodiment), and the rolling time was about 15 seconds. The working load in hot rolling was 40 kN.

The cooling rate in the temperature range from 950° to 600° C. was 40° C./s. that in the temperature range from 600° to 400° C. was 10° C./s., and that in the temperature range from 400° C. to room temperature was 2° C./s. The gear dimensions were ϕ183.6 in external diameter, 30° in spiral angle of helical teeth, 2.4 in module, and 6.713 in total tooth depth.

Upon measurement, the hardness of the overall teeth part was 450Hv. The metallic structure thereof was a mixed structure of martensite and fine pearlite. Thus, sufficient hardness can be obtained without re-heating the resultant gear after hot rolling for hardening.

The relation between the heating temperature to be held, dispersion amount of carbon, hardness after cooling will be explained.

The heating temperatures and duration of heating at such heating temperatures in the heating process affect the carbon content of the matrix, and accordingly, the hardness after cooling. It is preferable to set the heating temperature and duration of heating such that the carbon content of the matrix increases up to 0.4% or more in a time as short as possible. If the carbon content of the matrix is less than 0.4%, the pearlite transformation and ferrite transformation may be carried out during cooling, and the resultant hardness due to hardening is not high. In the heating process, the dispersion rate of carbon of the matrix increases with heating temperature. If the heating temperature is too low, the required heating time becomes longer, which lowers productivity and causes the transmission of heat throughout the entire gear blank 1 to deteriorate its accuracy. Therefore, it is preferable to set the heating temperature such that the duration of heating is as short as 60 seconds or less. From the result of experiments, it has been confirmed that by continuing heating at 1000° C. or more, the carbon content of the matrix can be increased up to 0.4% or more in the duration of heating of 60 seconds or less. In particular, where heating is continued at 1050° C. or more, the carbon content of the matrix can be increased up to 0.4% or more in the duration as short as several to 30 seconds. Where heating is continued at 1150° C. lower than the melting start temperature (1160° C.) by 10° C., the carbon content of the matrix can be increased up to 0.4% or more even in the duration of 0 second. By continuing heating at 1100° C. or more, the carbon content of the matrix can be increased up to 0.4% or more in several to fifteen seconds. Even at the cooling rate of 25° C./s. in the temperature range from 1000° to 600° C., a martensite-based structure having a predetermined hardness can be sufficiently obtained if the working ratio is proper. If the heating temperature to be held is higher than the temperature which is lower than the melting start temperature of the blank 1° by 10° C., the blank 1 may melt, so less desirable. If the heating temperature exceeds the above temperature range, and the duration of heating exceeds the above duration, the blank 1 may start to melt locally, so less desirable. From the experimental results, as shown in FIGS. 4 to 6, lowering of strength which would be caused by high temperature heating, was not observed. This can be considered to be caused by γ particles being crushed due to hot rolling to be transformed into fine particles.

Gears with various carbon contents of matrix and various working ratios in working during cooling were produced by varying the heating temperature to be held from 1100° to 1140° C. and varying the duration of heating from 0 to 60 seconds so as not to generate local melting. And the hardness of each gear was measured. The cooling rate after the heating process was 20° C./s. in both the temperature ranges from 1000° to 600° C. and from 600° to 400° C. The measurement results are shown in FIG. 13.

Figure 13:
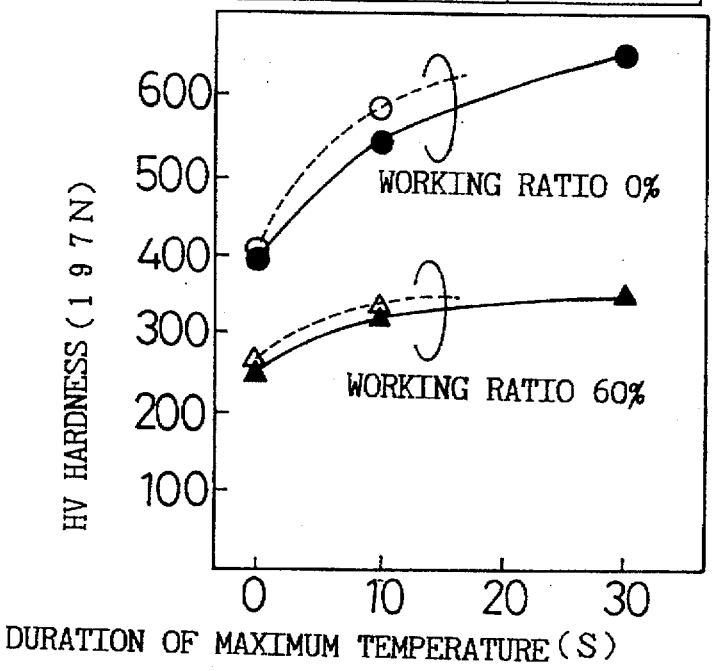
FIG. 13 is a graph showing the relation between the heating temperature, duration of heating, and hardness after cooling in the fourth embodiment.

As is apparent from FIG. 13, the hardness after cooling depends on the working ratio, but is adjustable in the range from 250 to 600 Hv by controlling the heating temperature and duration of heating. It has been confirmed that by increasing the cooling rate in the temperature range from 1000° to 600° C. to 25° C./s., the hardness increases up to 400 Hv even in the working ratio of 60%.

Hereinafter, a fifth embodiment of the present invention will be explained.

In the present embodiment, as is different from the first embodiment, a blank which had been hot rolled was subjected to a nitriding treatment in place of the hardening and temperng processes.

The nitriding conditions can be arbitrarily selected. For example, in sulfur nitriding, the temperature is 520° to 580° C., time is 80 to 240 minutes, the pressure-reduction ratio is 0.01 to 10 torr, the atmosphere is a mixture of nitrogen and ammonia gas, the plasma current is 6 to 10 A, the thickness of the compound layer is 0 to 35 μm, surface hardness is 50 to 950 HV.

In the present embodiment, sulfur nitriding was carried out under the conditions as follows: The temperature was 560° C., and the duration was 180 minutes, the pressure-reduction ratio was 0.1 torr, the atmosphere was a mixture of nitrogen and ammonia gas, and the plasma current was 8 A. The thickness of the resultant compound layer was 18 μm, and the surface hardness was 860 Hv.

Hereinafter, a sixth embodiment of the present invention will be explained.

In the present embodiment, as is different from the first embodiment, a blank which had been hot rolled was subjected to softnitriding in place of hardening and tempering.

The softnitriding conditions can be arbitrarily selected. For example, in gas softnitriding using a continuous treatment furnace, the temperature is 560° to 580° C., the duration is 180 to 240 minutes, the atmosphere is a mixture of nitrogen, ammonia gas and propane gas, the dew point is −5° to +15° C., the thickness of the compound layer is 15 to 40 μm , and the surface hardness is 550 to 1000 HV.

In the present embodiment, gas softnitriding was carried out under the conditions as follows: The temperature was 580° C., the duration was 180 minutes, the atmosphere was a mixture of nitrogen, ammonia gas and propane gas, and the dew point was +5° C. The thickness of the resultant compound layer was 22 μm, and the surface hardness was 735 Hv.

Hereinafter, a seventh embodiment of the present invention will be explained.

In the present embodiment, as is different from the first embodiment, a gear blank which had been hot rolled was subjected to shot peening in place of hardening and tempering.

The shot peening conditions can be arbitrarily selected. For example, in the case of an air nozzle type, the nozzle diameter is ϕ7 to 9 mm, the count of shot is once or twice, the diameter of shot particle is ϕ0.3 to 0.8 mm, the hardness of shot particle is 500 to 720 HV, the air pressure is 2 to 5 $kg/cm^2$, the duration of shot peening is 15 to 30 seconds, and the arc height is 0.4 to 0.7 mm. This results in the compression residual stress being decreased to the range of 50 to 140 $kgf/mm^2$.

In the present embodiment, the nozzle diameter was ϕ8 mm, the count of shot was once, the diameter of shot particle was ϕ0.3 mm, the hardness of shot particle was 700 HV, the air pressure was 4 $kg/cm^2$, the duration of shot peening was 30 seconds, and the arc height was 0.6 mm. The resultant compression residual stress decreased to 90 $kgf/mm^2$.

Hereinafter, an eighth embodiment of the present invention will be explained.

In the present embodiment, as is different from the first embodiment, a blank which had been hot rolled was subjected to sulfurizing and nitriding in place of hardening and tempering.

The sulfurizing and nitriding conditions can be arbitrarily selected. For example, the temperature is 550° to 580° C., the duration is 180 to 480 minutes, the atmosphere is a mixture of nitrogen, ammonia and hydrogen sulfide, the thickness of the compound layer is 10 to 20 μm, the depth of the nitrogen-dispersed layer is 0.2 to 0.4 mm, and the surface hardness is 650 to 900 HV. In the present embodiment, the temperature was 580° C., the duration was 240 minutes, the atmosphere was a mixture of nitrogen, ammonia and hydrogen sulfide, the thickness of the compound layer was 15 μm, the depth of the nitrogen-dispersed layer was 0.2 mm, and the surface hardness was 750 Hv. The treatments of the embodiments 6 to 8 can be carried out after hot rolling of the third embodiment in place of tempering, and can be also carried out after hot rolling of the second embodiment as the treatment serving as tempering.

Hereinafter, a ninth embodiment of the present invention will be explained. In the present embodiment, hardening and tempering after hot rolling in the first embodiment are replaced with finishing rolling on the teeth part in a predetermined temperature range to obtain a cast iron gear of the present embodiment.

The finishing rolling conditions can be arbitrarily selected. For example, the treating temperature is 600° to 300° C., the rolling time is 2 to 20 seconds, the working load during rolling is 10 to 40 kN.

In the present embodiment, finishing rolling was carried out for 10 seconds from 500° to 350° C. under the working load of 25 kN during rolling such that the tooth surface is pressed downwardly by 30 μm . Due to this treatment, the tooth surface accuracy could be improved by one class of JIS. This treatment can be also carried out in a cold state.

Hereinafter, a tenth embodiment of the present invention will be explained.

A blank was heated, similarly to the first embodiment, with induction heating under 60 kW and 10 kHz to the temperature range directly below the melting start temperature of the blank, which ranges from 1050° to 1140° C. (1070° C. in the present embodiment), and such temperature was maintained for 0 (no duration) to 30 seconds. Then, the affection of the change in heating depth on the rolling defect was examined.

Figure 14:
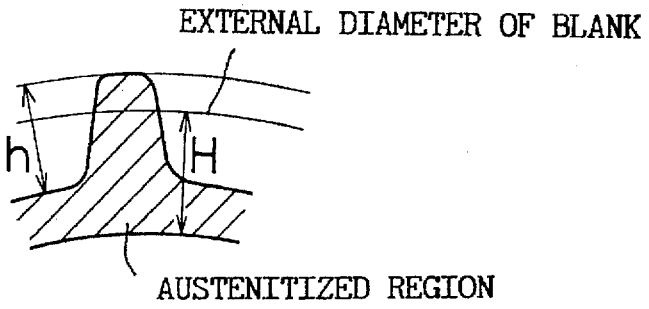
FIG. 14 is a diagram illustrating the relation between the heating depth H and the total tooth depth h in a tenth embodiment of a method in accordance with the present invention.

As shown in FIG. 14, the value of (heating depth H)/(total tooth depth h ) where the heating depth H means the depth from the blank diameter (ϕD in FIG. 1) to the innermost austenitized region hatched in FIG. 14 was varied from 1.2 to 2.0, and the temperature at the end of the formation of 90% of the total tooth depth was varied from 600° to 900° C. to examine flaws in the tooth surfaces after hot rolling. The result thereof is shown in FIG. 15.

Figure 15:
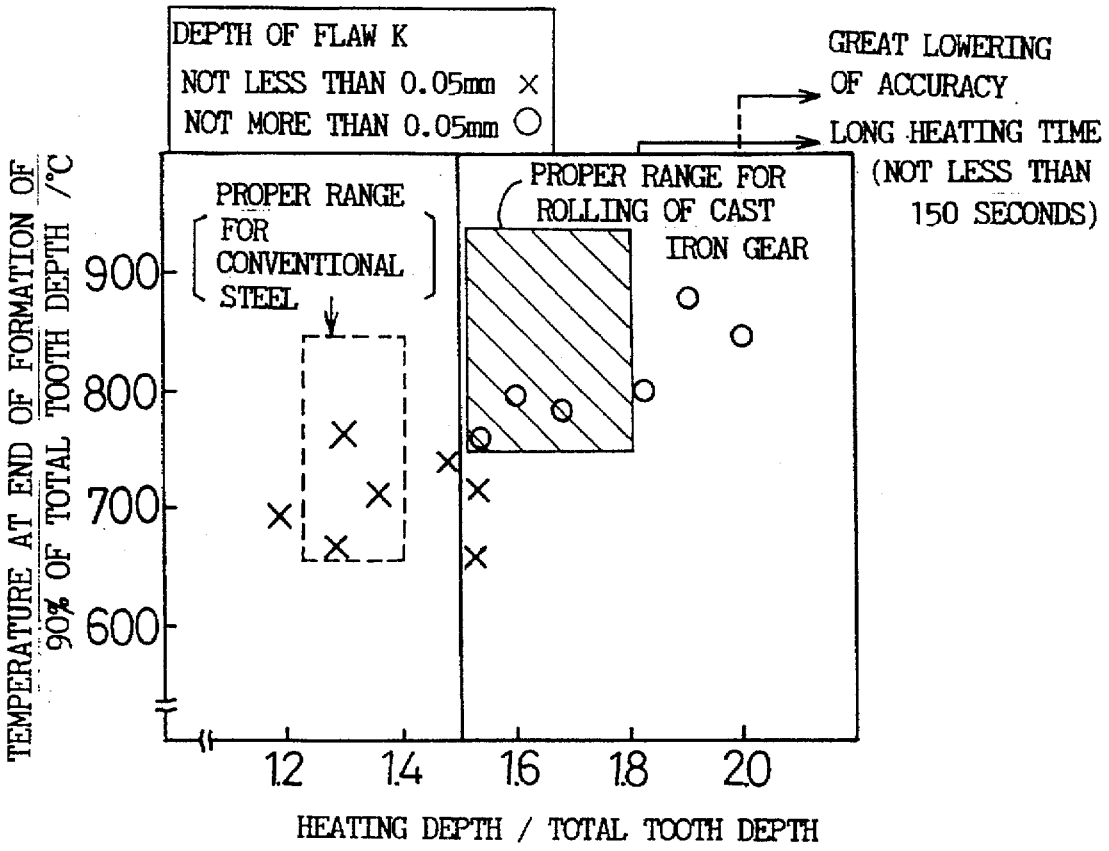
FIG. 15 is a graph showing the relation between the value of heating depth H/total tooth depth h, temperature at the end of the formation of 90% of the total tooth depth, and the flaw depth in the tenth embodiment.

As is apparent from FIG. 15, where the value of H/h ranges from 1.5 to 1.8, and the temperature at the end of the formation of 90% of the total tooth depth ranges from 750° to 900° C., the depth of the flaws in the tooth surfaces was as small as 0.05 mm or less. This can be considered to be caused by deterioration in formability of cast iron, as compared to the proper conditions of the conventional steel, as shown in FIG. 15. Where the value of H/h exceeds 1.8, the heating time is as long as 2.5 minutes or more, and the gear accuracy lowers greatly. Where the value of H/h exceeds 2.0, the gear accuracy lowers extremely.

Hereinafter, an eleventh embodiment will be explained. To examine the relation between the cast iron material and the working ratio, the following experiments were performed.

Figure 16:
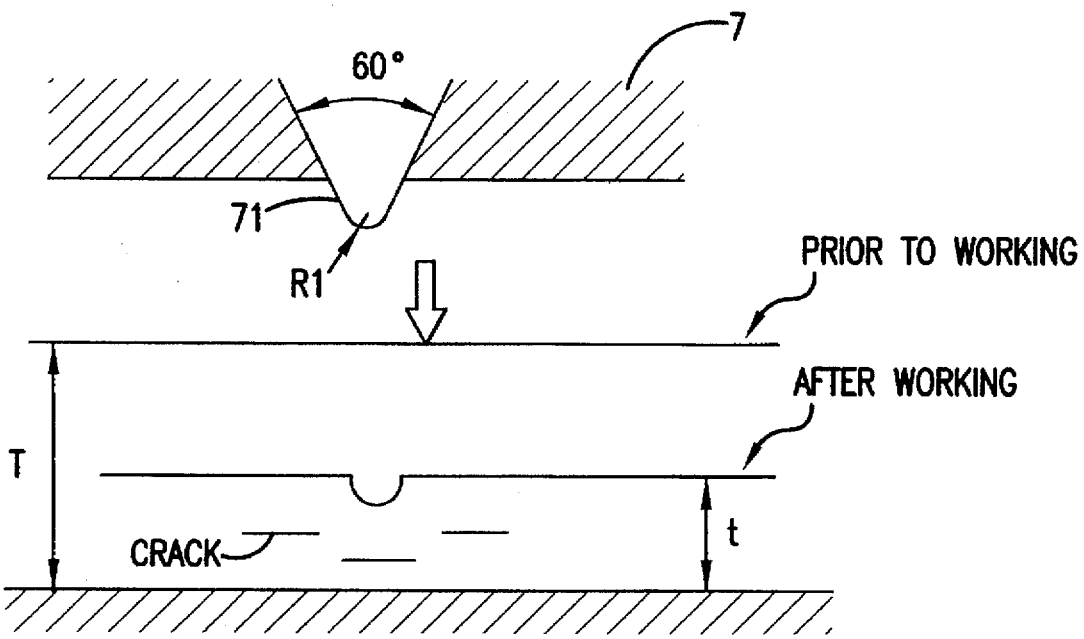
FIG. 16 is a diagram explaining the examination method of the working ratio and occurence of cracks in an eleventh embodiment of a method in accordance with the present invention.

A test piece No. 1 composed of FC230 (flake graphite cast iron) of 95 mm in length, 10 mm in width, and 15 mm in thickness T, and a test piece No. 2 composed of FCD500 (nodular graphite cast iron) having a configuration and dimensions identical to those of the test piece No. 1 were prepared. As shown in FIG. 16, by a press machine 7 having a projection 71 of 1.8 mm in height, which conforms to the configuration of the dedendum of a gear to be produced, these test pieces were pressed at a high frequency heating temperature of 1150° C. (temperature rising time is 40 seconds. and the duration is 0 second ), and a working temperature of 900° C. with various working ratios. The cooling rate in the temperature range from 1000° to 600° C. was 10° C./s.

Figure 17:
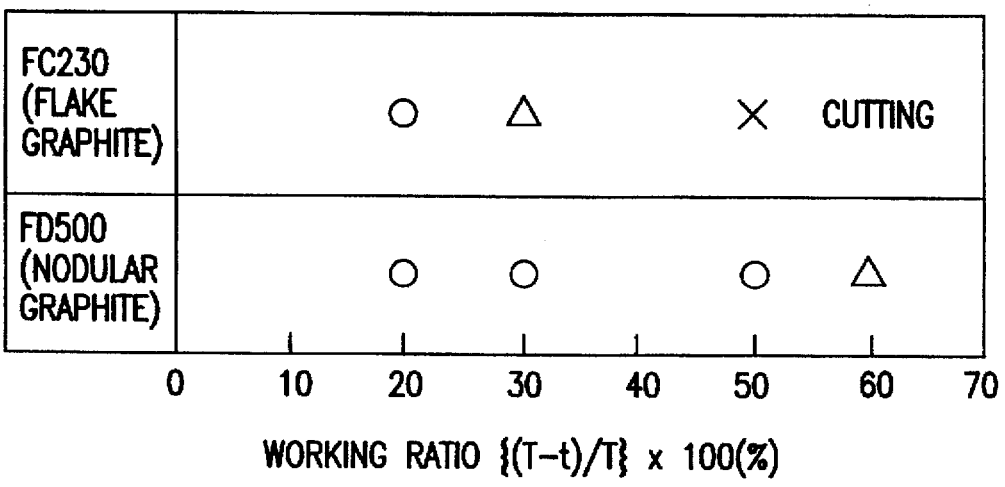
FIG. 17 is a graph showing the working ratio and occurrence of cracks in the eleventh embodiment.

The relation between the working ratio expressed by the following equation and the occurrence of cracks was examined. Reference character t denotes the thickness of test pieces after working. The result of examination is shown in FIG. 17. In the graph, symbol ○ shows the occurrence of no crack, symbol Δ shows the occurrence of a few cracks, and mark x shows the occurrence of many cracks.

$$(\text{WORKING RATIO})=\{(T-t)/T\}\times 100(\%)$$

where T is the thickness of test pieces prior to working, and t is that after working.

As is apparent from FIG. 17, in the flake graphite cast iron, the working ratio in which no crack occurs due to hot working is low, as compared to the case of the nodular graphite cast iron, but working thereof is possible to some extent. It can be judged from this result that the present invention can be also applied to compacted graphite cast iron containing caterpillar-like graphite particles by selecting a proper working ratio.

Hereinafter, a twelveth embodiment of the present invention will be explained.

A blank composed of FCD 500 (nodular graphite cast iron) was heated to 1150° C. by high frequency heating (temperature rising time is 40 seconds and duration is 0 second), then cooled from 1000° to 600° C. at a rate of 10° C./s. and cooled from 600° to room temperature at a rate of 2° C./s., thus producing test pieces with fine pearlite-based structures and having a hardness of 250 Hv. They were subjected to hot pressing, similarly to the eleventh embodiment, to obtain two kinds of test pieces, each having a V notch groove simulating the dedendum of a tooth profile, with working ratios of 30% and 50% in parallel parts, and 45% and 65% in V notch bottoms. The depth of each V notch groove was 4.3 mm (5.2 mm in parallel parts), the width thereof was 10 mm. For comparison, a test piece with the working ratio of 0% , which has a V notch groove formed by cutting, was also prepared.

Figure 18:
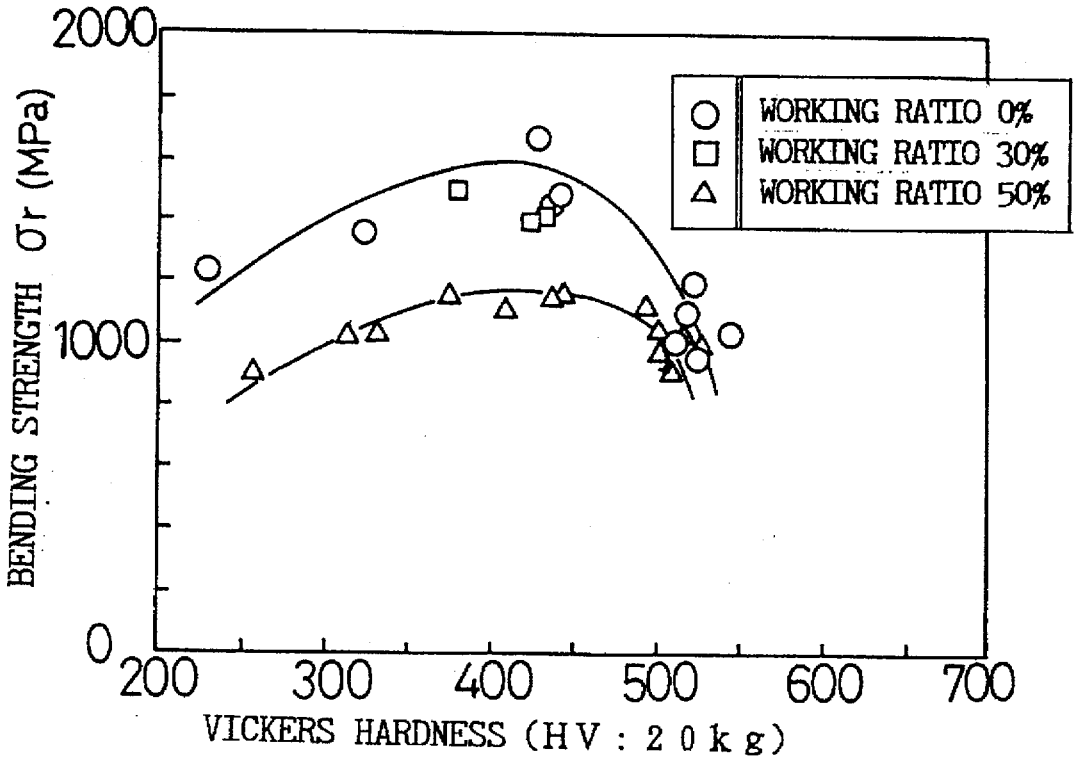
FIG. 18 is a graph showing the result of the bending test in the eleventh embodiment.
Figure 19:
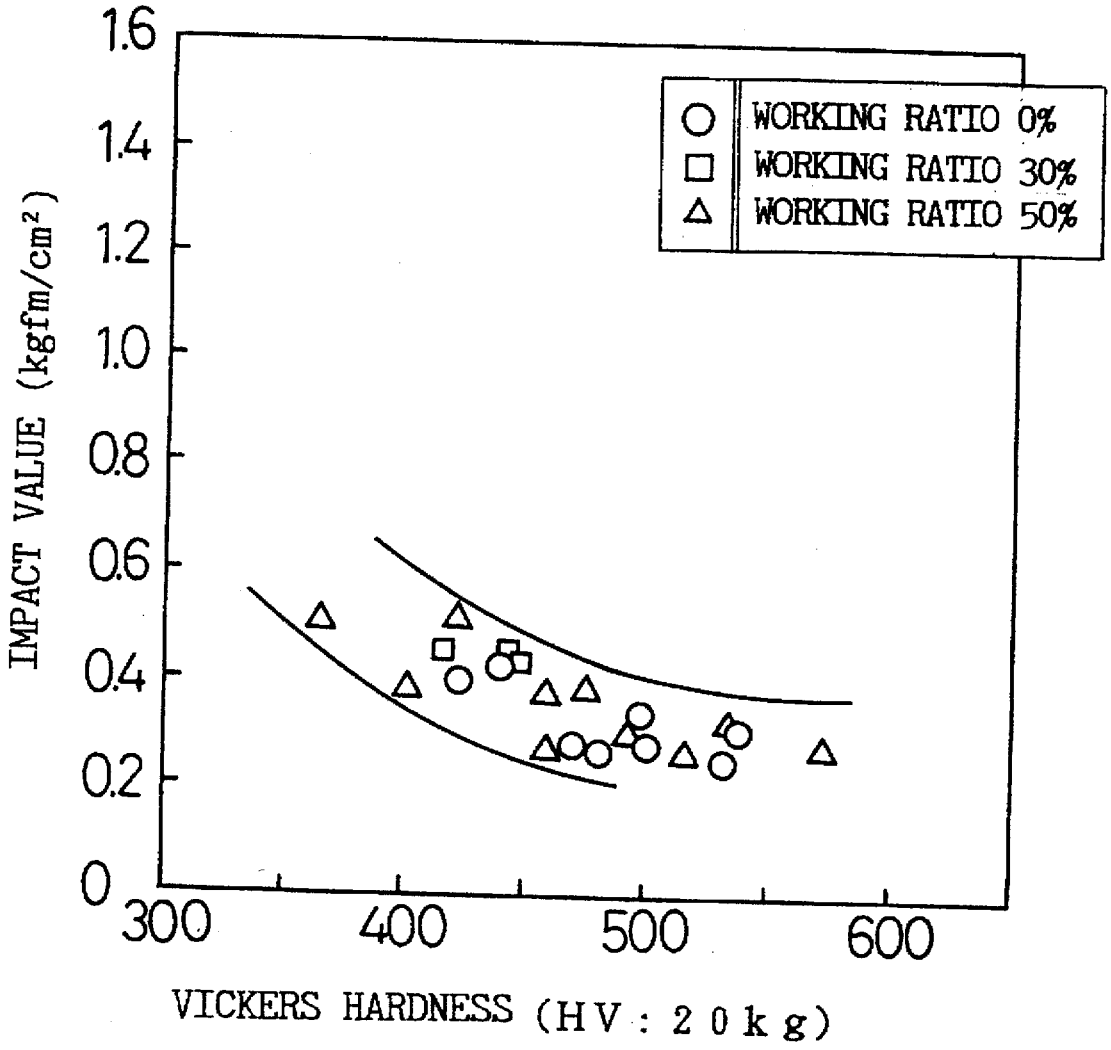
FIG. 19 is a graph showing the result of the impact test in the eleventh embodiment.
Figure 20:
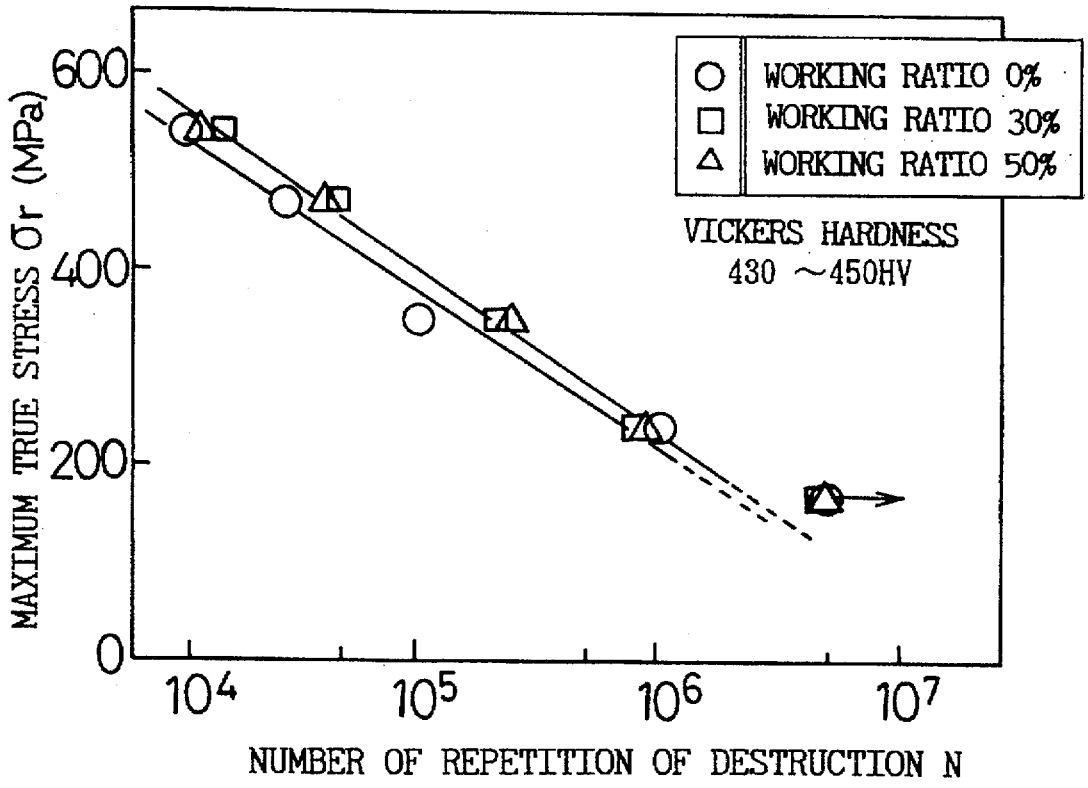
FIG. 20 is a graph showing the result of the bending fatigue test in the eleventh embodiment.

These test pieces were heated to 1050° C. in 30 seconds by high frequency induction heating, oil-quenched at 900° C., and then tempered at 300° to 600° C. to vary the hardness thereof from 300 to 550 Hv. Then, bending test, impact test and bending fatigue test were performed with each V notch bottom as a destruction start point. The obtained bending strength, impact value and bending fatigue strength are respectively shown in FIGS. 18, 19 and 20. In FIGS. 18 to 20, symbol ○ shows the results of test pieces with the working ratio of 0%, □ shows those with the working ratio of 30%, and Δ shows those with the working ratio of 50%.

As is apparent from FIGS. 18 to 20, in the test pieces of which the working ratio is 50%, lowering of bending strength was observed, but the impact value and bending fatigue strength which were important for effecting great strength were not affected by the working ratio. This indicates that by selecting the conditions of hot working and heat treatment of cast iron, even plastic working such as hot forging can be applied to the production of gear-like parts or other parts.

As is described above, the method for producing east iron gears in accordance with the present invention intends to generate a teeth part using hot rolling of which the plastic resistance during rolling is small. With the method of the present invention, cast iron gears having high accuracy, free from lowering of strength due to the exposure of graphite particles of cast iron, and occurrence of quenching cracks and rolling cracks, and accordingly having high strength, can be produced with good productivity and at reduced production costs.

While the invention has been described in connection with what are considered presently to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A method for producing cast iron gears comprising the steps of:

heating a blank composed of cast iron and having a teeth forming part adapted to be formed into a teeth part of said cast iron gears to such a temperature that at least said teeth forming part is at least austenitized; and hot rolling said teeth forming part of said blank by pressing projecting teeth of a rolling machine against said teeth forming part which is in a hot state and within an austenitized range, while cooling said blank, thereby generating said teeth part in said teeth forming part of said blank, wherein, in said heating step, said blank is heated such that said teeth forming part is austenitized to the depth of 1.5 to 1.8 times the total depth of said teeth part to be generated, and in said hot rolling step, the heating condition of said heating step is maintained and the temperature of said teeth forming part adapted to form not less than 90% of the total depth of said teeth part is maintained at not less than 750° C.

2. A method as claimed in claim 1, wherein, in said heating step, said blank is held in the temperature range lower than a melting start temperature of said blank by 10° to 160° C.

3. A method as claimed in claim 1, wherein, after said hot rolling step, at least one treatment out of nitriding, softnitriding and sulphurizing and nitriding treatments is carried out at a temperature lower than an austenite formation temperature.

4. A method as claimed in claim 1, wherein said method further comprises casting iron to form the blank composed of cast iron prior to heating the blank.

5. A method for producing cast iron gears comprising the steps of:

heating a blank composed of cast iron and having a teeth forming part adapted to be formed into a teeth part of said cast iron gears to such a temperature that at least said teeth forming part is at least austenitized; and hot rolling said teeth forming part of said blank by pressing projecting teeth of a rolling machine against said teeth forming part which is in a hot state and within an austenitized range, while cooling said blank, thereby generating said teeth part in said teeth forming part of said blank, wherein, after said heating step, said blank is cooled from 1000° to 600° C. at a rate of not less than 25° C/s., and then cooled from 600° to 400° C. at a rate of not less than 10° C/s., whereby said teeth part has one of a martensite-based structure and a mixed structure of martensite and fine pearlite.

6. A method as claimed in claim 5, wherein, in said heating step, said blank is held in the temperature range lower than a melting start temperature of said blank by 10° to 160° C.

7. A method as claimed in claim 5, wherein, after said hot rolling step, at least one treatment out of nitriding, softnitriding and sulphurizing and nitriding treatments is carried out at a temperature lower than an austenite formation temperature.

8. A method as claimed in claim 5, wherein said method further comprises casting iron to form the blank composed of cast iron prior to heating the blank.

9. A method for producing cast iron gears comprising the steps of:

heating a blank composed of cast iron and having a teeth forming part adapted to be formed into a teeth part of said cast iron gears to such a temperature that at least said teeth forming part is at least austenitized; and hot rolling said teeth forming part of said blank by pressing projecting teeth of a rolling machine against said teeth forming part which is in a hot state and within an austenitized range, while cooling said blank, thereby generating said teeth part in said teeth forming part of said blank, wherein, after said heating step, said blank is cooled by one of a first cooling process and a second cooling process, said first cooling process comprising cooling from 1000° to 600° C. at a rate of not less than 25° C./s., and then cooling from 600° to 400° C. at a rate of not less than 1° C./s. and less than 10° C./s., and said second cooling process comprising cooling from 1000° to 600° C. at a rate of not less than 1° C./s. and less than 25° C./s., whereby said teeth part has one of a fine pearlite-based structure and a mixed structure of ferrite and pearlite.

10. A method as claimed in claim 9, wherein, in said heating step, said blank is held in the temperature range lower than a melting start temperature of said blank by 10° to 160° C.

11. A method as claimed in claim 9, wherein, after said hot rolling step, at least one treatment out of nitriding, softnitriding and sulphurizing and nitriding treatments is carried out at a temperature lower than an austenite formation temperature.

12. A method as claimed in claim 9, wherein said method further comprises casting iron to form the blank composed of cast iron prior to heating the blank.

13. A method as claimed in claim 9, wherein said blank is cooled by said first cooling process.

* * * * *